US007427971B2

(12) United States Patent
Eom

(10) Patent No.: US 7,427,971 B2
(45) Date of Patent: Sep. 23, 2008

(54) LIGHT EMITTING DISPLAY AND DRIVING METHOD THEREOF

(75) Inventor: Ki-Myeong Eom, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 570 days.

(21) Appl. No.: 11/077,354

(22) Filed: Mar. 9, 2005

(65) Prior Publication Data

US 2005/0212446 A1 Sep. 29, 2005

(30) Foreign Application Priority Data

Mar. 24, 2004 (KR) ..... 10-2004-0019957

(51) Int. Cl.
*G09G 3/20* (2006.01)
*G09G 3/30* (2006.01)
*G09G 3/32* (2006.01)

(52) U.S. Cl. ..... 345/82; 345/55; 345/76; 345/92

(58) Field of Classification Search ..... 345/55–100, 345/204–214; 315/169.1–169.4
See application file for complete search history.

(56) References Cited

U.S. PATENT DOCUMENTS

| | | | | |
|---|---|---|---|---|
| 7,277,071 | B2 * | 10/2007 | Oh | 345/76 |
| 2003/0090446 | A1 | 5/2003 | Tagawa et al. | |
| 2004/0217925 | A1 * | 11/2004 | Chung et al. | 345/76 |
| 2004/0239658 | A1 | 12/2004 | Koyama et al. | |
| 2005/0024339 | A1 | 2/2005 | Yamazaki et al. | |
| 2005/0057580 | A1 * | 3/2005 | Yamano et al. | 345/690 |

FOREIGN PATENT DOCUMENTS

| | | |
|---|---|---|
| CN | 1417761 A | 5/2003 |
| JP | 2003-108067 | 4/2003 |
| JP | 2003-186437 | 7/2003 |
| JP | 2003-195824 | 7/2003 |

(Continued)

OTHER PUBLICATIONS

Korean Patent Abstracts for publication No. 10200200097420, publication date Dec. 31, 2002, in the name of H. Baek et al.

(Continued)

*Primary Examiner*—David L Lewis
(74) *Attorney, Agent, or Firm*—Christie, Parker & Hale, LLP

(57) ABSTRACT

A light emitting display which includes pixel circuits, each of the pixel circuits being operated by at least two different scan signals and being capable of performing a bi-directional scanning operation. The light emitting display includes a bi-directional signal transmission shift register, the pixel circuits, and a signal applier. Each of the pixel circuits is provided with two or more scan lines. The scan lines include first and second scan lines. The shift register outputs first signals in a first direction in response to a first control signal, and outputs second signals in a second direction opposite to the first direction in response to a second control signal. The signal applier sequentially applies, to the scan lines of the pixel circuits, first scan signals corresponding to respective ones of the first signals or second scan signals corresponding to respective ones of the second signals.

20 Claims, 7 Drawing Sheets

FOREIGN PATENT DOCUMENTS

| | | | |
|---|---|---|---|
| JP | 2003-255856 | | 9/2003 |
| KR | 2002-0097420 | | 12/2002 |
| KR | 10-2004-0009285 | | 1/2004 |
| WO | WO 2004/049285 | A1 | 6/2004 |

OTHER PUBLICATIONS

Korean Patent Abstracts for publication No. 1020040009285, publication date Jan. 31, 2004, in the name of O. Kwon.

Patent Abstracts of Japan, Publication No. 2003-108067; Date of Publication: Apr. 11, 2003; in the name of Shoichiro Matsumoto.

Patent Abstracts of Japan, Publication No. 2003-186437; Date of Publication: Jul. 4, 2003; in the name of Koichi Yamada.

Patent Abstracts of Japan, Publication No. 2003-255856; Date of Publication: Sep. 10, 2003; in the name of Yoshinao Kobayashi et al.

Patent Abstracts of Japan, Publication No. 2003-195824, dated Jul. 9, 2003, in the name Yutaka Ozawa.

* cited by examiner

LIGHT EMITTING DISPLAY AND DRIVING METHOD THEREOF

CROSS REFERENCE TO RELATED APPLICATION

This application claims priority to and the benefit of Korean Patent Application No. 10-2004-0019957 filed on Mar. 24, 2004, in the Korean Intellectual Property Office, the contents of which are incorporated herein by reference.

BACKGROUND OF THE INVENTION (a) Field of the Invention

The present invention relates to a display device and a driving method thereof, and more particularly to an organic electroluminescent (EL) light emitting display utilizing EL light emission of an organic material, and a method for driving the organic EL light emitting display.

(b) Description of the Related Art

Generally, organic EL displays are display devices that emit light by electrically exciting an organic compound. Such an organic EL display includes n×m organic light emitting cells arranged in the form of a matrix, and displays an image by driving the organic light emitting cells, using voltage or current.

Organic light emitting cells can also be referred to as "organic light emitting diodes (OLEDs)" because they have diode characteristics. As shown in FIG. 1, each organic light emitting cell has a structure including an anode electrode, an organic thin film, and a cathode electrode. The organic thin film has a multi-layer structure including an emitting layer (EML), an electron transport layer (ETL), and a hole transport layer (HTL) to improve balance between electrons and holes and to improve light emitting efficiency. The organic thin film also includes an electron injecting layer (EIL) and a hole injecting layer (HIL). As discussed above, organic light emitting cells are arranged in an n×m matrix to form an organic EL display panel of an organic EL display. In addition, when transparent electrodes are used for both the anode and cathode electrodes of an organic light emitting cell, it is possible to implement a double-sided organic EL display.

Driving methods for an organic EL display panel can be classified as either a passive matrix type driving method or an active matrix type driving method using thin film transistors (TFTs). In accordance with the passive matrix type driving method, anodes and cathodes are arranged to be orthogonal to each other so that a desired line to be driven is selected. In accordance with the active matrix type driving method, thin film transistors are coupled to respective indium tin oxide (ITO) pixel electrodes in an organic EL display panel so that the organic EL display panel is driven by a voltage maintained by the capacitance of a capacitor coupled to the gate of each thin film transistor.

FIG. 2 is a block diagram schematically illustrating an organic EL display including the organic EL element.

As shown in FIG. 2, the organic EL display includes an organic EL display panel 100, a scan driver 200, and a data driver 300.

The organic EL display panel 100 includes a plurality of data lines D1 to Dm extending in a column direction, a plurality of scan lines S1 to Sn extending in a row direction, and a plurality of pixel circuits 110. Each of the data lines D1 to Dm transmits a data signal indicative of an image signal to respective ones of the pixel circuits 110. Each of the scan lines S1 to Sn transmits a scan signal to respective ones of the pixel circuits 110. Each pixel circuit 110 is formed at a pixel region defined by neighboring ones of the data lines D1 to Dm and neighboring ones of the scan lines S1 to Sn. Hereinafter, pixel circuits (or pixels) corresponding to the pixel circuits 110 are denoted in association with scan lines, to which the pixel circuits are coupled. For example, the pixel circuits (or pixels) coupled to the scan line S1 are denoted by "P1", and the pixel circuits (or pixels) coupled to the scan line Sn are denoted by "Pn".

The scan driver 200 applies a scan signal to the scan lines S1 to Sn in a sequential manner. The data driver 300 then applies data voltages corresponding to input image signals to the data lines D1 to Dm, respectively.

The scan driver 200 and/or data driver 300 may be coupled to the display panel 100. Alternatively, the scan driver 200 and/or data driver 300 may be mounted, in a chip, on a flexible printed circuit (FPC) or a film bonded to the display panel 100 and coupled to the display panel 100. Alternatively, the scan driver 200 and/or data driver 300 may be directly mounted on a glass substrate of the display panel 100. Also, the scan driver 200 and/or data driver 300 may be directly mounted on the glass substrate so that the scan driver 200 and/or data driver 300 may be substituted for drive circuits respectively formed on the same layers as those of the scan lines, data lines, and thin film transistors.

Korean Patent Laid-open Publication No. 2002-0097420 discloses a bi-directional data driver including a bi-directional shift register to bi-directionally apply a data signal, the entire content of which is incorporated herein by reference. That is, in an organic EL display capable of implementing double-sided display, images displayed on the front and back screens of the organic EL display are horizontally inverted from each other (e.g., left to right and right to left). In order to display the same image on the front and back screens, accordingly, the order of applying data signals to the data lines in association with the image display on the front screen must be bi-directionally applied or reverse to the order of applying the data signals to the data lines in association with the image display on the back screen. For example, the m-th (or last) data signal to be applied to the data line Dm for the image display on the front screen must be applied to the data line D1 for the image display on the back screen.

On the other hand, where it is desired to display the same image even when the display panel is inverted in the vertical direction as well as in the horizontal direction, for example, in accordance with a 180° rotation thereof (e.g., up to down and down to up or top to bottom and bottom to top), the scan driver must also use a bidirectional shift register to bi-directionally apply a scan signal, similar to the application of the data signal by the bi-directional data driver. That is, in the case of an EL display including a 180°-rotatable display panel, a bi-directional scan driver is used to change the order of sequentially applying scan signals to scan lines between the sequential selection of the scan lines in a downward direction (hereinafter, referred to as "forward scan") and the sequential selection of the scan lines in an upward direction (hereinafter, referred to as "backward scan"), and thus, to display the same image on the screen in both the non-rotated state and the rotated state. For example, the bi-directional scan driver applies the first scan signal, to be the scan line S1 in a forward scan mode, to the scan line Sn in a backward scan mode, and applies the n-th scan signal, to be applied to the scan line Sn in the forward scan mode, to the scan line S1 in the backward scan mode.

In accordance with the above-mentioned conventional techniques, however, there is a problem in driving certain pixel circuits. For example, in a pixel circuit configuration disclosed in Korean Patent Laid-open Publication No. 2004-

0009285, the entire content of which is incorporated herein by reference, each pixel circuit can operate, based on at least two different scan signals. For example, the pixel circuit Pn can operate, based on the n-th scan signal applied to the current scan line Sn and the "n−1"-th scan signal applied to the preceding scan line Sn−1. In particular, the pixel circuit Pn is arranged to operate normally in the forward scan mode in accordance with the "n−1"-th scan signal applied to the scan line Sn−1 and the n-th scan signal subsequently applied to the scan line Sn. However, this pixel circuit Pn cannot properly (or normally) operate in the backward scan mode when the application order of scan signals to the scan lines is reversed such that the first (or previous) scan signal is applied to the scan line Sn (or current scan line), and the second (or next or current) scan signal is then applied to the scan line Sn−1 (or previous scan line).

SUMMARY OF THE INVENTION

It is an aspect of the present invention to provide a light emitting display having a plurality of pixel circuits each of which operates with at least two different scan signals, and are capable of performing a bi-directional scanning operation.

One exemplary embodiment of the present invention provides a display device that includes a bi-directional signal transmission shift register, a plurality of pixel circuits, and a signal applier. The bi-directional signal transmission shift register sequentially outputs first signals in a first direction in response to a first control signal, and sequentially outputs second signals in a second direction opposite to the first direction in response to a second control signal. The pixel circuits are each provided with at least two scan lines including a first scan line and a second scan line. The signal applier receives third signals corresponding to respective ones of the first signals sequentially outputted from the shift register or fourth signals corresponding to respective one of the second signals sequentially outputted from the shift register, and sequentially applies first scan signals based on the received third signals or second scaln signals based on the received fourth signals to the scan lines of the pixel circuits. The signal applier performs the application of the first scan signals in response to the first control signal such that one of the first scan signals is first applied to the first scan line of a current one of the pixel circuits, and a next one of the first scan signals following the one of the first scan signals applied to the first scan line of the current one of the pixel circuits is then applied to the second scan line of the current one of the pixel circuits, and the signal applier performs the application of the second scan signals in response to the second control signal such that one of the second scan signals is first applied to the first scan line of the current one of the pixel circuits, and a next one of the second scan signals following the one of the second scan signals applied to the first scan line of the current one of the pixel circuits is then applied to the second scan line of the current one of the pixel circuits.

The next one of the first scan signals may also be applied to the first scan line of a next one of the pixel circuits. In this case, the signal applier may comprise a first switch to selectively couple an input line to input the next one of the first scan signals to the second scan line of the current one of the pixel circuits, and a second switch to selectively couple the input line to the first scan line of the next one of the pixel circuits.

The next one of the second scan signals may also be applied to the first scan line of a previous one of the pixel circuits. In this case, the signal applier may comprise a first switch to selectively couple an input line to input the next one of the second scan signals to the second scan line of the current one of the pixel circuits, and a second switch to selectively couple the input line to the first scan line of the previous one of the pixel circuits.

The current and the previous and/or the next one of the pixel circuits may be arranged adjacent to each other.

One exemplary embodiment of the present invention provides a light emitting display that includes a bi-directional signal transmission shift register, a first pixel circuit, and a signal applier. The bi-directional signal transmission shift register sequentially outputs first and second signals in a first direction in response to a first control signal, and sequentially outputs third and fourth signals in a second direction opposite to the first direction in response to a second control signal. The first pixel circuit includes a first scan line and a second scan line. The signal applier applies the first signal to the first scan line and the second signal to the second scan line in response to the first control signal, and applies the third signal to the first scan line and the fourth signal to the second scan line in response to the second control signal.

The light emitting device may further include a data driver to generate data signals to be transmitted in a first direction, based on the first control signal, to generate the data signals to be transmitted in a second direction, based on the second control signal, and to apply the data signals to data lines.

The light emitting device may further include a second pixel circuit arranged adjacent to the first pixel circuit in the first direction. The second signal may be applied to a first scan line of the second pixel circuit.

The light emitting device may further include a third pixel circuit arranged adjacent to the first pixel circuit in the second direction. The fourth signal may be applied to a first scan line of the third pixel circuit.

One exemplary embodiment of the present invention provides a method for driving a light emitting display that includes a plurality of pixel circuits and a scan driver. The pixel circuit includes first and second pixel circuits each of which is coupled to first and second scan lines and a data line. The scan driver applies scan signals to the scan lines. The method, in a first-direction scan mode, applies a first one of the scan signals to the first scan line of the first pixel circuit, and then applies a second one of the scan signals to the second scan line of the first pixel circuit and to the first scan line of the second pixel circuit; and the method, in a second-direction scan mode, applies the first scan signal to the first scan line of the second pixel circuit, and then applies the second scan signal to the second scan line of the second pixel circuit and to the first scan line of the first pixel circuit.

DETAILED DESCRIPTION

Figure 1:
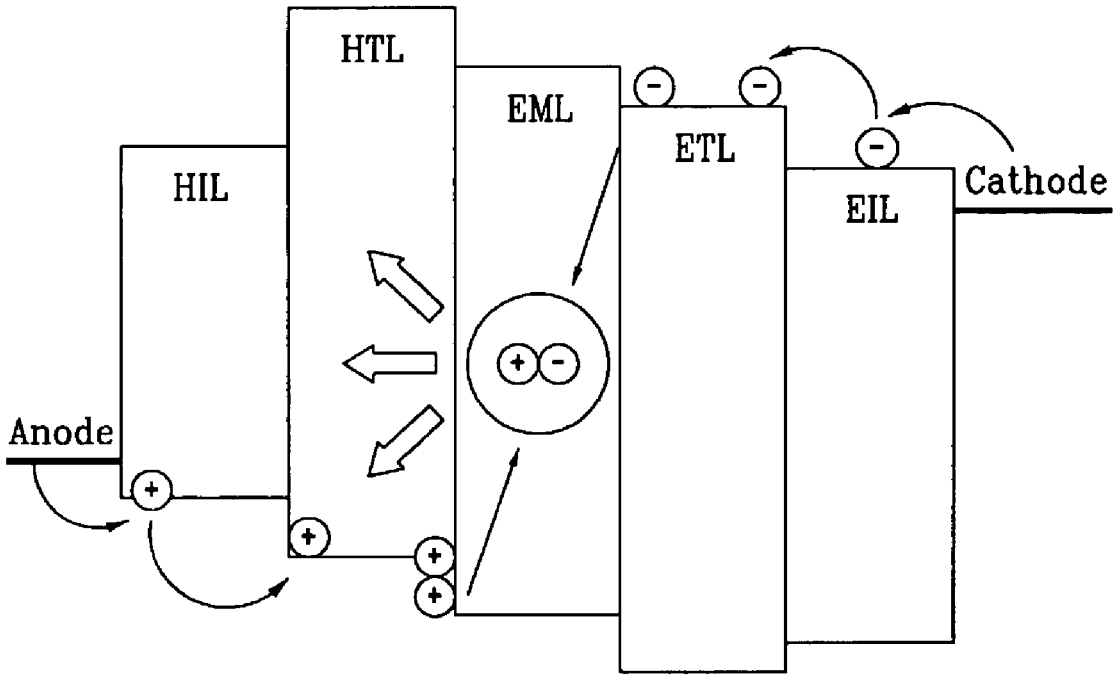
FIG.1 (Prior Art)
FIG. 1 is a conceptual diagram of an organic EL element.
Figure 2:
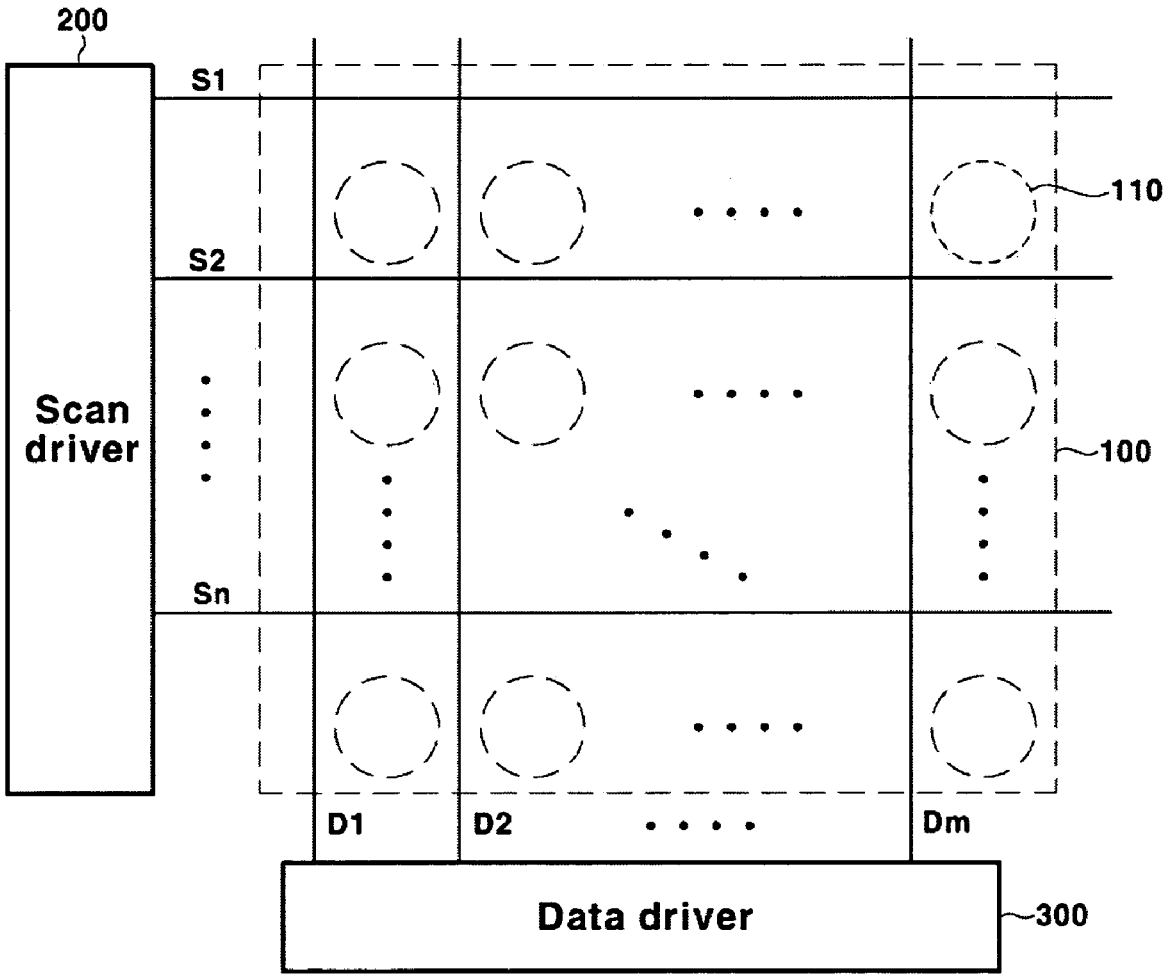
FIG.2 (Prior Art)
FIG. 2 is a block diagram schematically illustrating an organic EL display including the organic EL display element.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. In the drawings, illustrations of certain elements having little or no relation with the present invention are omitted to better clarify the present invention. In the specification, like reference numerals indicate like elements and/or.

Hereinafter, an exemplary embodiment of the present invention will be described with reference to FIGS. 3, 4, 5, 6, and 7.

Figure 3:
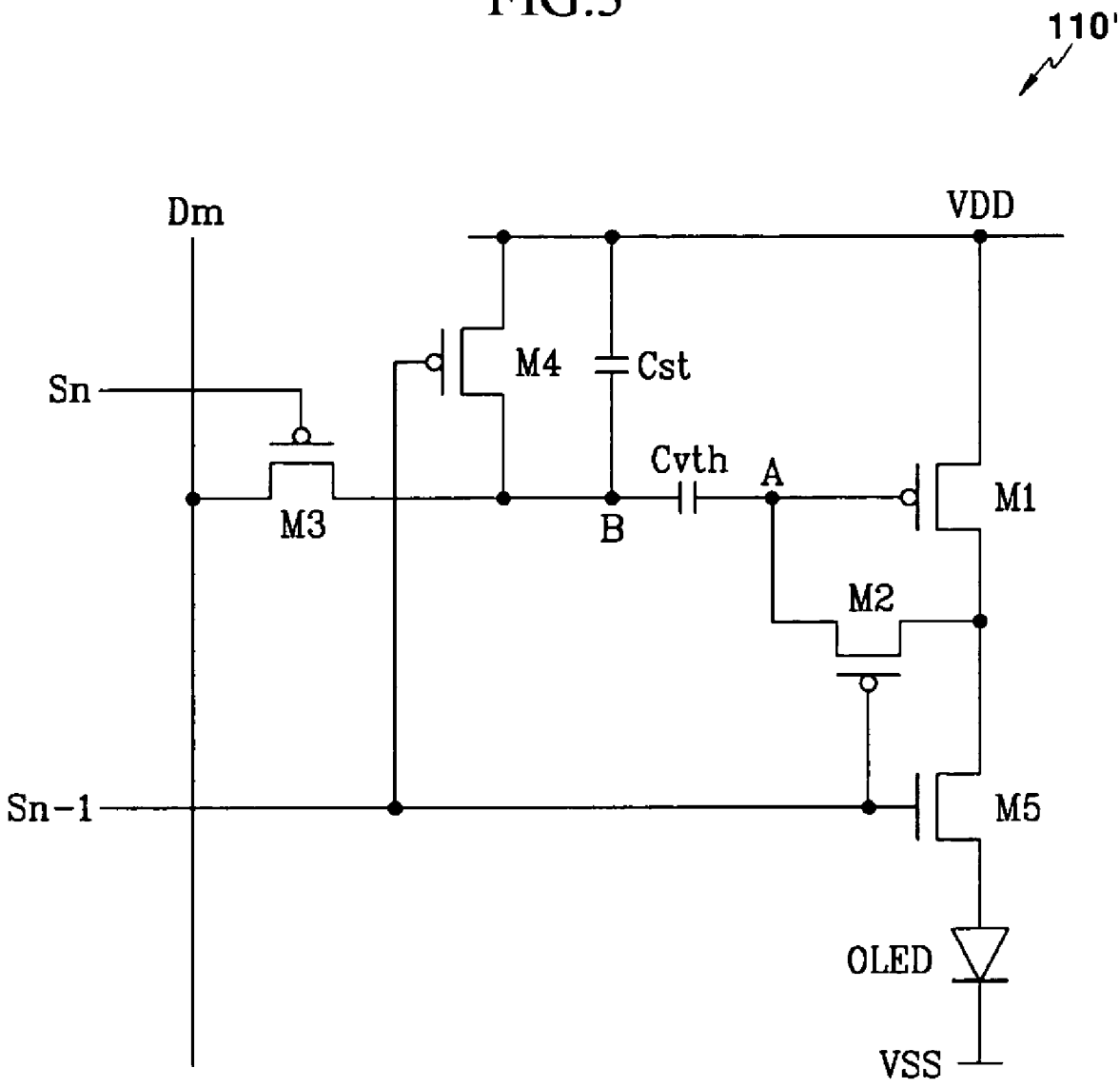
FIG. 3 is an equivalent circuit diagram of a pixel circuit according to an exemplary embodiment of the present invention.

FIG. 3 is an equivalent circuit diagram of a pixel circuit according to the exemplary embodiment of the present invention.

For convenience of description and illustration, only one pixel circuit, which is coupled to an m-th data line Dm and an n-th scan line Sn, is shown in FIG. 3. Meanwhile, terms associated with scan lines are defined as follows: the scan line, which is currently being applied with (or used to apply) a scan signal, is referred to as the "current scan line"; and the scan line, which is being applied with (or used to apply) a scan signal just before the application of the current scan signal, is referred to as the "previous scan line".

As shown in FIG. 3, the pixel circuit 10' according to the illustrated embodiment of the present invention includes transistors M1, M2, M3, M4, and M5, capacitors Cst and Cvth, and an organic EL element OLED.

The transistor M1 is a driving transistor to drive the organic EL element OLED. The transistor M1 is coupled between a voltage source to supply a supply voltage VDD and the organic EL element OLED. The transistor M1 controls current flowing through the organic EL element OLED through the transistor M5, based on a voltage applied to a gate of the transistor M1. The transistor M2 responds to the scan signal from the previous scan line Sn−1 to diode connect the transistor M1 (i.e., to cause the transistor M1 to operate as a diode).

The capacitor Cvth is coupled, at one electrode A thereof, to the gate of the transistor M1. The capacitor Cst and the transistor M4 are coupled in parallel between the other electrode B of the capacitor Cvth and the voltage source to supply the supply voltage VDD. The transistor M4 responds to the scan signal from the previous scan line Sn-1 to supply the supply voltage VDD to the other electrode B of the capacitor Cvth.

The transistor M3 responds to the scan signal from the current scan line Sn to apply data (or a data voltage) from the data line Dm to the other electrode B of the capacitor Cvth.

The transistor M5 is coupled between a drain of the transistor M1 and an anode of the organic EL element OLED. The transistor M5 responds to the scan signal from the previous scan line Sn−1 to cut off the electric coupling between the drain of the transistor M1 and the organic EL element OLED.

The organic EL element emits light in proportion to current inputted thereto (e.g., from transistor M1 when it is electrically coupled to the organic EL element OLED). A voltage VSS having a level lower than the supply voltage VDD is coupled to a cathode of the organic EL element OLED. For the voltage VSS, a ground voltage may be used.

An operation of the pixel circuit having the above-described arrangement will be described.

First, when a scan voltage of a low level is applied to the previous scan line Sn−1, the transistor M2 is turned on and diode connects the transistor M1 to cause the transistor M1 to operate as a diode. Accordingly, the gate-source voltage of the transistor M1 varies until it reaches a threshold voltage (Vth) of the transistor M1. In this case, the voltage applied to the electrode A (or Node A) of the capacitor Cvth corresponds to the sum of the supply voltage VDD and the threshold voltage (Vth) because the source of the transistor M1 is coupled to the supply voltage VDD. The transistor M4 is also turned on by the scan voltage from the previous scan line Sn−1, so that the supply voltage VDD is applied to the electrode B (or Node B) of the capacitor Cvth. As a result, a voltage ($V_{Cvth}$) is charged in the capacitor Cvth. The charged voltage ($V_{Cvth}$) can be expressed by the following Equation 1:

$$V_{Cvth}=V_{CvthA}-V_{CvthB}=(VDD+Vth)-VDD=Vth \quad \text{[Equation 1]}$$

where, "$V_{Cvth}$" represents a voltage charged in the capacitor Cvth, "$V_{CvthA}$" represents a voltage applied to the electrode A (or node A) of the capacitor Cvth, and "$V_{CvthB}$" represents a voltage applied to the electrode B (or node B) of the capacitor Cvth.

The transistor M5, which is an N-type transistor, is turned off in response to the low-level signal from the previous scan line Sn−1, thereby preventing current from the transistor M1 from flowing through the organic EL element OLED. The channel type of the transistor is used for exemplary purposes and the present invention is not thereby limited. Of course, those skilled in the art would recognize that the voltage polarities and levels may be different when other transistors or transistor types are used.

Next, when a scan voltage of a low level is applied to the current scan line Sn, the transistor M3 is turned on, so that a data voltage (Vdata) is applied to the node B. In this case, a voltage corresponding to the sum of the data voltage (Vdata) and the threshold voltage (Vth) of the transistor M1 is applied to the gate of the transistor M1 because a voltage corresponding to the threshold voltage (Vth) of the transistor M1 has been charged in the capacitor Cvth. That is, gate-source voltage (Vgs) of the transistor M1 can be expressed by the following Equation 2:

$$Vgs=(Vdata+Vth)-VDD \quad \text{[Equation 2]}$$

When the low-level scan voltage is applied to the current scan line Sn, a high-level scan voltage is applied to the previous scan line Sn-1. In response to the high-level scan voltage, the transistor MS is turned on, current ($I_{OLED}$) corresponding to the gate-source voltage (Vgs) of the transistor M1 is supplied to the organic EL element OLED. As a result, the organic EL element OLED emits light. The current ($I_{OLED}$) can be expressed by the following Equation 3:

$$\begin{aligned} I_{OLED} &= \frac{\beta}{2}(Vgs - Vth)^2 \\ &= \frac{\beta}{2}(Vdata + Vth - VDD) - Vth)^2 \\ &= \frac{\beta}{2}(VDD - Vdata)^2 \end{aligned} \quad \text{[Equation 3]}$$

where, "$I_{OLED}$" represents current flowing through the organic EL element OLED, "Vgs" represents the voltage between the source and gate of the transistor M1, "Vth" represents the threshold voltage of the transistor M1, "Vdata" represents the data voltage, and "β" represents a constant.

Thus, the transistor M2 is maintained in an OFF state during the period when data is charged in response to the application of the scan signal from the previous scan line Sn−1 to block the flow of leakage current. Accordingly, the transistor M2 assists in a reduction of power consumption and helps to correctly represent a black gray scale.

Although the pixel circuit according to the exemplary embodiment of the present invention has been described as including five transistors and two capacitors, the present invention is not limited thereto. The present invention is applicable to any pixel circuits which are operable based on at least two scan signals (e.g., from a current scan line and a previous scan line).

Figure 4:
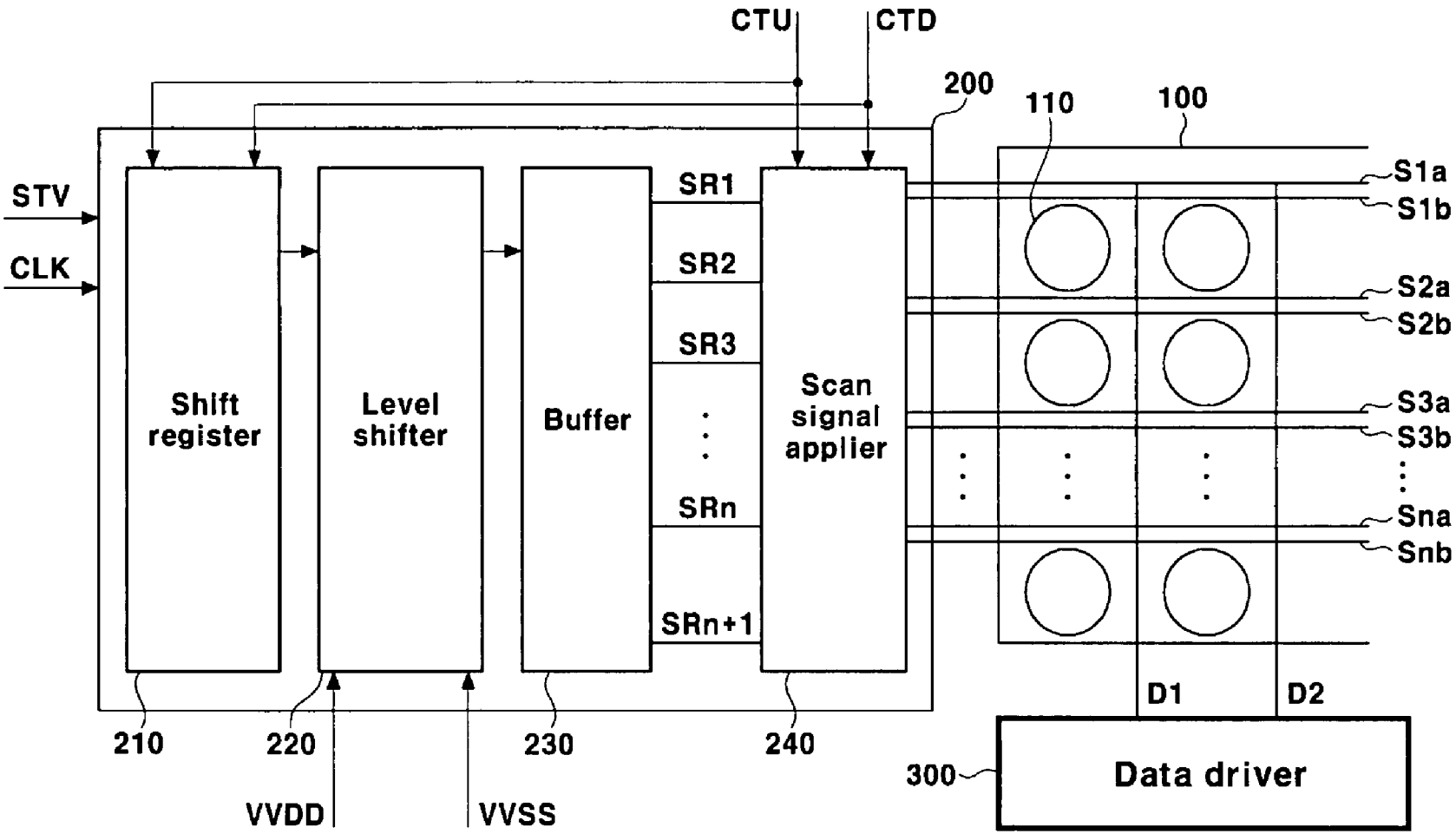
FIG. 4 is a block diagram schematically illustrating the configuration of a light emitting display including pixel circuits each having the arrangement of FIG. 3.

FIG. 4 is a block diagram schematically illustrating the configuration of a light emitting display including pixel circuits each having the arrangement of FIG. 3.

As shown in FIG. 4, the light emitting display includes a display panel 100, a scan driver 200, and a data driver 300.

The display panel 100 can display the same image on the screen in both a normal screen state and a 180°-rotated screen state. The display panel 100 includes n×m pixel circuits (or pixels) arranged in the form of a matrix. Hereinafter, each of the pixel circuits (or pixels) can be denoted by "Pk" (where "k" is a natural number between 1 and n). A pixel circuit, which has the arrangement of FIG. 3, is provided at each pixel region. Each pixel region is defined by a pair of adjacent scan lines Ska and Skb and one data line Dm crossing the scan lines Ska and Skb. Each pixel circuit (or pixel) Pk is coupled with the two respective (or associated) scan lines Ska and Skb, which apply different scan signals. In this case, the active elements, which operate based on the same scan signal in each pixel Pk, are coupled to the same scan line. For example, where the pixel Pk corresponds to the pixel circuit of FIG. 3, the scan line Ska corresponds to the previous scan line (e.g., Sn−1) coupled with the transistors M2, M4, and M5, and the scan line Skb corresponds to the current scan line (e.g., Sn) coupled with the transistor M3. In addition, the scan line Ska (e.g., S2*a*) in a forward scan mode may be the same as or is being applied with the same signal as the scan line Sk−1*b* (e.g., S1*b*) or the scan line Ska (e.g., S2*a*) in a backward scan mode may be the same as or is being applied with the same scan signal as the scan line Sk+1*b* (e.g., S3*b*). However, the invention is not thereby limited. Moreover, the number of scan lines S1*a*, S1*b*, S2*a*, S2*b*, . . . , Sna, Snb can correspond to 2 times the number of the pixel rows, that is, 2n (n: the number of the pixel rows).

The data driver 300 is a bidirectional data driver including a bi-directional shift register, which can bi-directionally apply a data signal, as described above.

The scan driver 200 includes a shift register 210, a level shifter 220, a buffer 230, and a scan signal applier 240.

The shift register 210 is a bi-directional shift register capable of performing a bi-directional scanning operation. The shift register 210 receives a start signal STV, a clock signal CLK, a forward scan control signal CTU, and a backward scan control signal CTD, generates first through "n+1"-th scan signals SR1 to SRn+1 to be applied to respective scan lines S1*a*, S1*b*, S2*a*, S2*b*, . . . , Sna, Snb, based on the received signals, and outputs the generated scan signals SR1 to SRn+1. In more detail, when the forward scan control signal CTU is rendered to an enable level, the shift register 210 sequentially shifts the start signal STV in accordance with the clock signal CLK that is periodically inputted to the shift register 210 to sequentially output n+1 signals as the scan signals SR1 to SRn+1, in this order. On the other hand, when the backward scan control signal CTD is rendered to the enable level, the shift register 210 sequentially shifts the start signal STV in accordance with the clock signal CLK that is periodically inputted to the shift register 210 to sequentially output n+1 signals as the scan signals SRn+1 to SR1, in this order.

The level shifter 220 receives voltages VVDD and VVSS from respective voltage sources (not shown), and thus, shifts the first through "n+1"-th scan signals SR1 to SRn+1 received from the shift register 210 to a predetermined voltage level.

The buffer 230 buffers the first through "n+1"-th scan signals SR1 to SRn+1 shifted to the predetermined voltage level, and subsequently applies the buffered scan signals to the scan signal applier 240.

The scan signal applier 240 operates to apply the scan signals SR1 to SRn+1 to the associated scan lines S1*a*, S1*b*, S2*a*, S2*b*, . . . , Sna, Snb, respectively, in response to the forward scan control signal CTU or backward scan control signal CTD. That is, when the forward scan control signal CTU is in its ON state, the scan signals SR1 to SRn are applied to the scan lines of a first scan line group "a", that is, the scan lines S1*a*, S2*a*, S3*a*, S4*a*, . . . , Sna, respectively. In this case, the scan signals SR2 to SRn+1 are also applied to the scan lines of a second scan line group "b", that is, the scan lines S1*b*, S2*b*, S3*b*, S4*b*, . . . , Snb, respectively. Thus, using the scan signal applier 240, the scan signal SR1 is applied to the scan line S1*a*, and the scan signal SR2 is applied to the scan lines S1*b* and S2*a*. Similarly, the scan signal SRn is applied to the scan lines Sn−1*b* and Sna, and the scan signal SRn+1 is applied to the scan line Snb.

On the other hand, when the backward scan control signal CTD is in its ON state, the scan signals SRn+1 to SR2 are applied to the scan lines of the first scan line group "a", that is, the scan lines Sna, Sn−1*a*, Sn−2*a*, . . . , S2*a*, S1*a*, respectively. In this case, the scan signals SRn to SR1 are also applied to the scan lines of the second scan line group "b", that is, the scan lines Snb, Sn−1*b*, Sn−2*b*, . . . , S2*b*, S1*b*, respectively. Thus, the scan signal SRn+1 is applied to the scan line Sna, and the scan signal SRn is applied to the scan lines Snb and Sn−1*a*. Similarly, the scan signal SR2 is applied to the scan lines S2*b* and S1*a*, and the scan signal SR1 is applied to the scan line S1*b*.

Accordingly, the display panel, in which, in each pixel, the active elements M2, M4, and M5 operating in response to the previous scan signal are coupled to the associated scan line of the scan line group "a", and the active element M3 operating in response to the current scan signal is coupled to the associated scan line of the scan line group "b", can normally display an image irrespective of the scan mode because the previous (or earlier in order) scan signal is always applied to the associated scan line of the scan line group "a", and the current (or later in order) scan signal is always applied to the associated scan line of the scan line group "b", in both the forward and backward scan modes.

Figure 5:
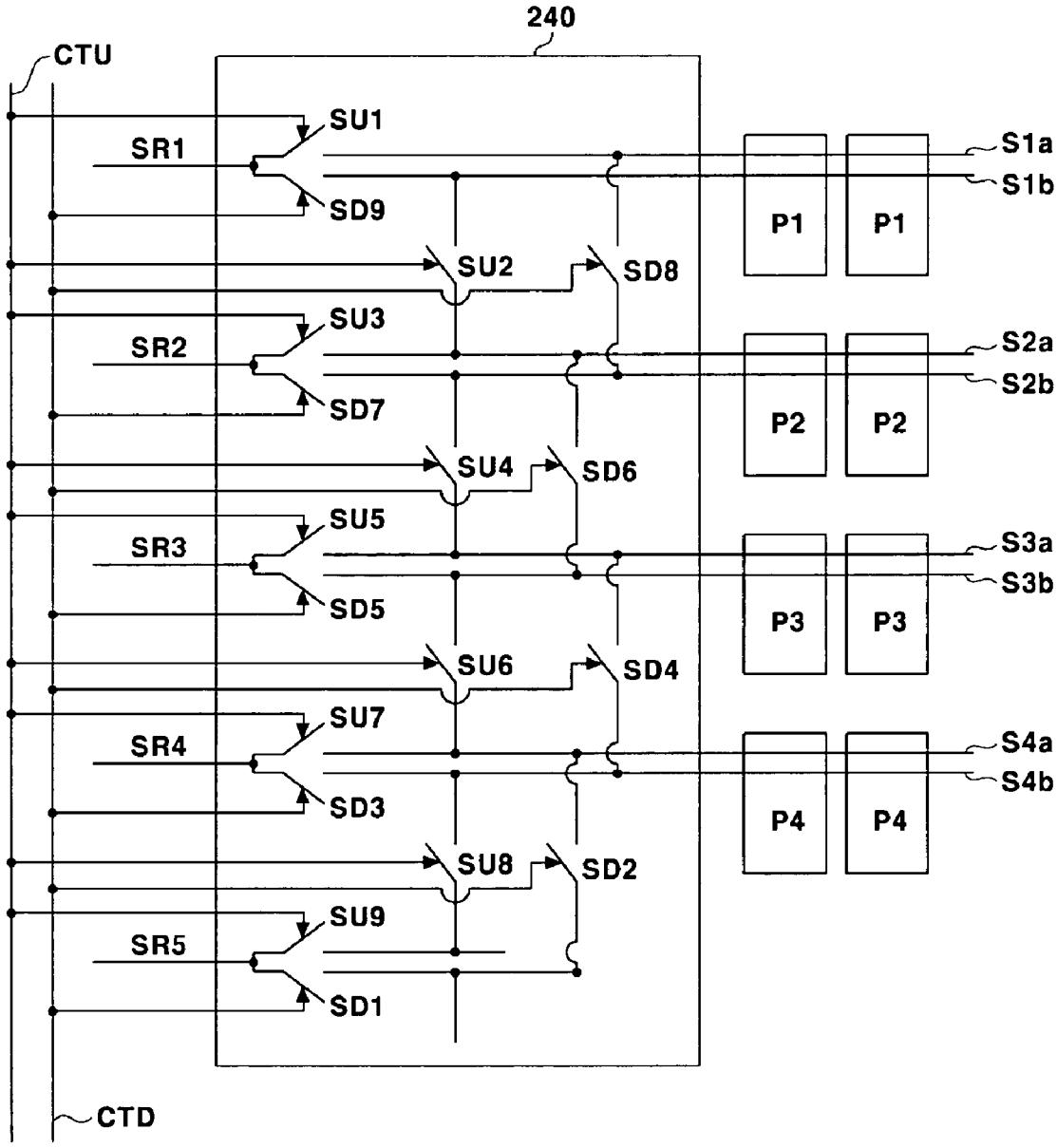
FIG. 5 is a circuit diagram illustrating the configuration of a scan signal applier shown in FIG. 4.

FIG. 5 is a circuit diagram illustrating the configuration of the scan signal applier 240 shown in FIG. 4.

For convenience of description and illustration, the following description will be given in conjunction with an example in which the number of pixels, n, is 4 (P1 to P4), the number of scan signals is 5 (SR1 to SR5), and the number of scan lines is 8 (S1*a*, S1*b*, S2*a*, S2*b*, S3*a*, S3*b*, S4*a*, and S4*b*). However, the invention is not thereby limited.

The scan signal applier 240 includes switches SU1 to SU9 to control the application of the scan signals SR1, SR2, SR3, SR4, and SR5 outputted from the buffer 230 to the scan lines S1*a*, S1*b*, S2*a*, S2*b*, S3*a*, S3*b*, S4*a*, and S4*b* coupled in pairs to respective pixels, in response to a forward scan control signal CTU. The scan signal applier 240 also includes switches SD1 to SD9 to control the application of the scan signals SR1, SR2, SR3, SR4, and SR5 outputted from the buffer 230 to the scan lines S1*a*, S1*b*, S2*a*, S2*b*, S3*a*, S3*b*, S4*a*, and S4*b* coupled in pairs to respective pixels, in response to a backward scan control signal CTD. The scan signal SR1 is applied to the scan lines S1*a* and S1*b* via the switches SU1 and SD9, respectively. The scan signal SR2 is applied to the scan line S2*a* via the switch SU3, and to the scan line and S1*b* via the switches SU3 and SU2, respectively. The scan signal SR2 is also applied to the scan line S2*b* via the switch SD7, and to the scan line S1*a* via the switches SD7 and SD8. The scan signal SR3 is applied to the scan line S3*a* via the switch SU5, and to the scan line and S2*b* via the switches SU5 and SU4, respectively. The scan signal SR3 is also applied to the scan line S3*b* via the switch SD5, and to the scan line S2*a* via the switches SD5 and SD6. The scan signal SR4 is applied to the scan line S4*a* via the switch SU7, and to the scan line and S3*b* via the switches SU7 and SU6, respectively. The scan signal SR4 is also applied to the scan line S4*b* via the switch SD3, and to the scan line S3*a* via the switches SD3 and SD4. The scan signal SR5 is applied to the scan line S4*b* via the switches SU9 and SU8, and to the scan line S4*a* via the switches SD1 and SD2. The switches SU1 to SU9 are turned on in response to the forward scan control signal CTU, and the switches SD1 to SD9 are turned on in response to the backward scan control signal CTD.

When all the switches SU1 to SU9 are turned on in response to the forward scan control signal CTU, the scan signals SR1 to SR4 are applied to the scan lines S1*a*, S2*a*, S3*a*, and S4*a* of the scan line group "a", respectively, and the scan signals SR2 to SR5 are applied to the scan lines S1*b*, S2*b*, S3*b*, and S4*b* of the scan line group "b", respectively. Accordingly, the pixel P1 is driven by the scan signals SR1 and SR2 sequentially applied to respective scan lines S1*a* and S1*b*, and the pixel P2 is driven by the scan signals SR2 and SR3 sequentially applied to respective scan lines S2*a* and S2*b*. Similarly, the pixel P3 is driven by the scan signals SR3 and SR4 sequentially applied to respective scan lines S3*a* and S3*b*, and the pixel P4 is driven by the scan signals SR4 and SR5 sequentially applied to respective scan lines S4*a* and S4*b*.

On the other hand, when all the switches SD1 to SD9 are turned on in response to the backward scan control signal CTD, the scan signals SR5 to SR2 are applied to the scan lines S4*a*, S3*a*, S2*a*, and S1*a* of the scan line group "a", respectively, and the scan signals SR4 to SR1 are applied to the scan lines S4*b*, S3*b*, S2*b*, and S1*b* of the scan line group "b", respectively. Accordingly, the pixel P4 is driven by the scan signals SR5 and SR4 sequentially applied to respective scan lines S4*a* and S4*b*, and the pixel P3 is driven by the scan signals SR4 and SR3 sequentially applied to respective scan lines S3*a* and S3*b*. Similarly, the pixel P2 is driven by the scan signals SR3 and SR2 sequentially applied to respective scan lines S2*a* and S2*b*, and the pixel P1 is driven by the scan signals SR2 and SR1 sequentially applied to respective scan lines S1*a* and S1*b*.

Figure 6:
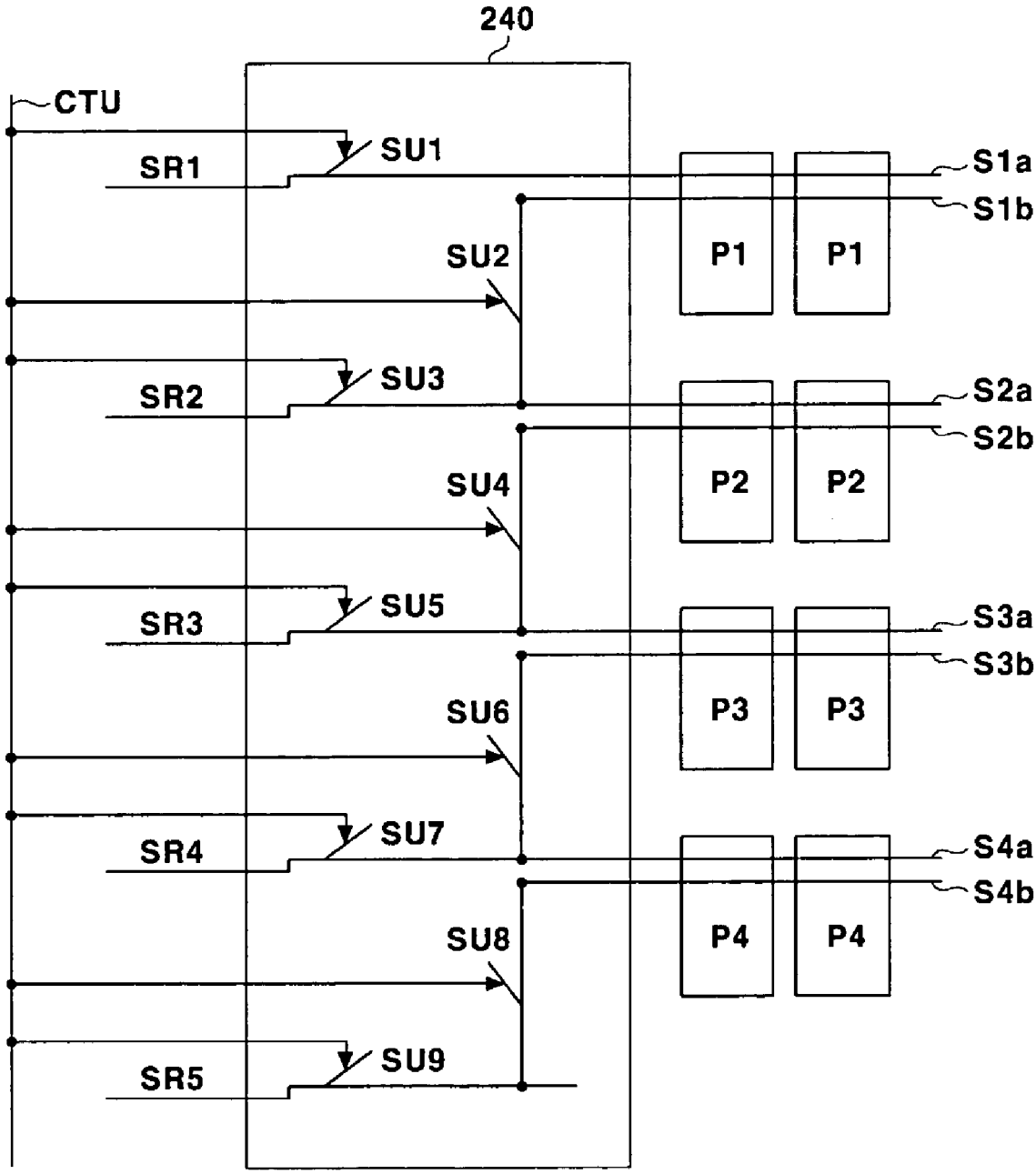
FIG. 6 is a circuit diagram illustrating scan line switching states of the scan signal applier shown in FIG. 5 in a forward scan mode.
Figure 7:
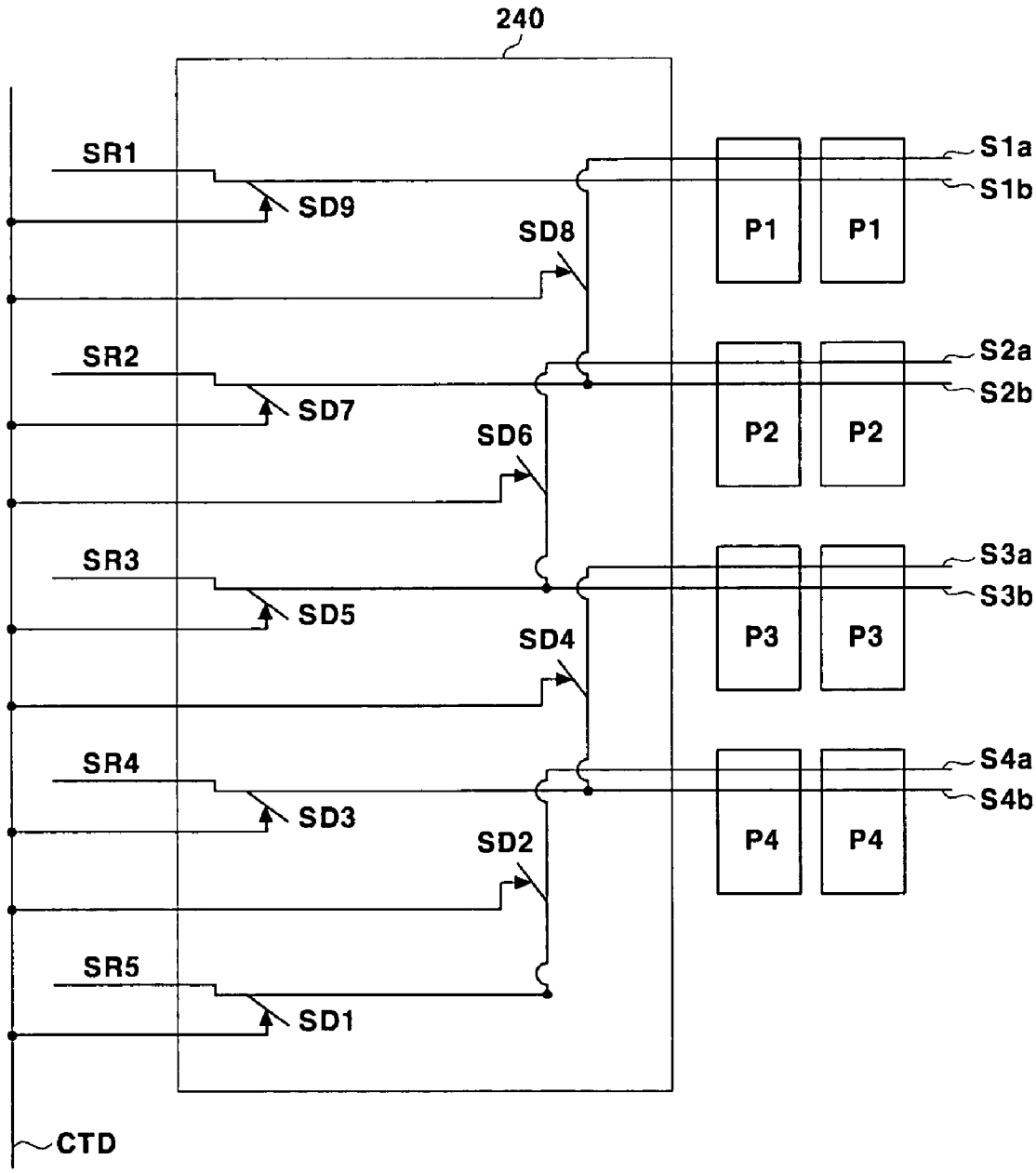
FIG. 7 is a circuit diagram illustrating scan line switching states of the scan signal applier shown in FIG. 5 in a backward scan mode.

FIG. 6 is a circuit diagram illustrating switched states of the scan lines in a forward scan mode, and FIG. 7 is a circuit diagram illustrating switched states of the scan lines in a backward scan mode.

Referring now to FIG. 6, when a forward scan control signal CTU is inputted as a switch-on signal in the forward scan mode, all the switches SU1 to SU9 are switched on.

Accordingly, the scan signal SR1 is applied to the scan line S1*a* via the switch SU1, as the previous scan signal for the pixel P1.

The scan signal SR2 is applied to the scan line S2*a* via the switch SU3 and is applied to the scan line S1*b* via the switches SU3 and SU2. Accordingly, the scan signal SR2 is applied as the current scan signal for the pixel P1 via the scan line S1*b* and is applied as the previous scan signal for the pixel P2 via the scan line S2*a*.

The scan signal SR3 is applied to the scan line S3*a* via the switch SU5 and is applied to the scan line S2*b* via the switches SU5 and SU4. Accordingly, the scan signal SR3 is applied as the current scan signal for the pixel P2 via the scan line S2*b* and is applied as the previous scan signal for the pixel P3 via the scan line S3*a*.

The scan signal SR4 is applied to the scan line S4*a* via the switch SU7 and is applied to the scan line S3*b* via the switches SU7 and SU6. Accordingly, the scan signal SR4 is applied as the current scan signal for the pixel P3 via the scan line S3*b* and is applied as the previous scan signal for the pixel P4 via the scan line S4*a*.

Also, the scan signal SR5 is applied to the scan line S4*b* via the switches SU9 and SU8 and is applied as the current scan signal for the pixel P4.

Thus, all pixels are driven, based on previous and current scan signals sequentially applied for the pixels under the condition in which the switches SU1 to SU9 are turned on by the switch-on signal of the forward scan control signal CTU.

Referring now to FIG. 8, the switched states of the scan lines in the backward scan mode will be described.

When a backward scan control signal CTD is inputted as a switch-on signal in the backward scan mode shown in FIG. 7, all the switches SD1 to SD9 are switched on.

Accordingly, the scan signal SR5 is applied to the scan line S4*a* via the switches SD1 and SD2, as the previous scan signal for the pixel P4.

The scan signal SR4 is applied to the scan line S4*b* via the switch SD3 and is applied to the scan line S3*a* via the switches SD3 and SD4. Accordingly, the scan signal SR4 is applied as the current scan signal for the pixel P4 via the scan line S4*b* and is applied as the previous scan signal for the pixel P3 via the scan line S3*a*.

The scan signal SR3 is applied to the scan line S3*b* via the switch SD5 and is applied to the scan line S2*a* via the switches SD5 and SD6. Accordingly, the scan signal SR3 is applied as the current scan signal for the pixel P3 via the scan line S3*b* and is applied as the previous scan signal for the pixel P2 via the scan line S2*a*.

The scan signal SR2 is applied to the scan line S2*b* via the switch SD7 and is applied to the scan line S1*a* via the switches SD7 and SD8. Accordingly, the scan signal SR2 is applied as the current scan signal for the pixel P2 via the scan line S2*b* and is applied as the previous scan signal for the pixel P1 via the scan line S1*a*.

Also, the scan signal SR1 is applied to the scan line S1*b* via the switch SD9 and is applied as the current scan signal for the pixel P1.

Thus, all pixels are driven, based on previous and current scan signals sequentially applied for the pixels under the condition in which the switches SD1 to SD9 are turned on by the switch-on signal of the backward scan control signal CTD.

In view of the switch states of FIGS. 7 and 8, all previous scan signals are always applied to the pixel circuits via the associated scan lines of the scan line group "a", that is, the scan lines S1*a*, S2*a*, S3*a*, and S4*a*, respectively, and all current scan signals are always applied to the pixel circuits via the associated scan lines of the scan line group "b", that is, the scan lines S1*b*, S2*b*, S3*b*, and S4*b*, irrespective of whether the current scan mode is the forward scan mode or the backward scan mode.

Accordingly, even when the display panel, which includes pixel circuits each adapted to operate based on two different scan signals, is rotated 180°, it can still properly display the image through the backward scanning mode.

In view of the foregoing, an exemplary embodiment of the present invention bi-directionally drives a light emitting display. The light emitting display includes pixel circuits each operating based on at least two different scan signals and provides scan lines in a number corresponding to the number of the scan signals to be applied to respective pixel circuits (or pixels). The scan signals are sequentially applied to respective pixels based on a forward scan control signal to control a forward scan mode (in which the scan signals are sequentially applied in a forward direction) and a backward scan control signal to control a backward scan mode (in which the scan signals are sequentially applied in a backward direction).

While this invention has been described in connection with certain exemplary embodiments, it is to be understood that the invention is not limited to the disclosed embodiments, but, on the contrary, is intended to cover various modifications included within the spirit and scope of the appended claims, and equivalents thereof.

For example, although the present invention has been described in conjunction with an exemplary embodiment in which each pixel circuit operates based on two different scan signals, it may be applied to the case in which each pixel circuit operates based on three or more different scan signals. In this case, of course, the number of scan lines must correspond to 3 times the number of pixel rows. In addition, although the present invention has been described in conjunction with an exemplary embodiment in which the scan signal applier is coupled to the buffer of the scan driver and/or may be within the scan driver, the scan signal applier may be provided, separately (and/or located away) from the scan driver. Also, the scan signal applier and scan driver may be integrally formed in the form of a single chip so that they may be mounted on one glass substrate of the display panel.

What is claimed is:

1. A display device comprising:

a first pixel circuit and a second pixel circuit, each of the first pixel circuit and the second pixel circuit being coupled to a corresponding previous scan line of a plurality of scan lines, a corresponding current scan line of the scan lines, and a data line; and a scan driver for applying a plurality of scan signals to the scan lines;

wherein the scan driver applies a previous one of the scan signals to the previous scan line of the first pixel circuit and then applies a current one of the scan signals to the current scan line of the first pixel circuit and to the previous scan line of the second pixel circuit in response to a first control signal; and wherein the scan driver applies the previous one of the scan signals to the previous scan line of the second pixel circuit and then applies the current one of the scan signals to the current scan line of the second pixel circuit and to the previous scan line of the first pixel circuit in response to a second control signal.

2. The display device of claim 1, further comprising a data driver for applying a plurality of data signals sequentially in a first direction to the data lines of the first and second pixel circuits based on the first control signal and for applying the plurality of data signal sequentially in a second direction to the data lines of the first and second pixel circuits based on the second control signal.

3. A display device comprising:

a bi-directional signal transmission shift register for sequentially outputting a plurality of first signals in a first direction in response to a first control signal and for sequentially outputting a plurality of second signals in a second direction opposite to the first direction in response to a second control signal;

a plurality of pixel circuits, each of the pixel circuits being provided with at least two scan lines comprising a first scan line and a second scan line; and a signal applier for receiving a plurality of third signals corresponding to respective ones of the first signals sequentially outputted from the shift register or a plurality of fourth signals corresponding to respective ones of the second signals sequentially outputted from the shift register and for sequentially applying a plurality of first scan signals based on the received third signals or a plurality of second scan signals based on the received fourth signals to the scan lines of the pixel circuits;

wherein the signal applier performs the application of the first scan signals in response to the first control signal such that one of the first scan signals is first applied to the first scan line of a current one of the pixel circuits, and a next one of the first scan signals following the one of the first scan signals applied to the first scan line of the current one of the pixel circuits is then applied to the second scan line of the current one of the pixel circuits, and wherein the signal applier performs the application of the second scan signals in response to the second control signal such that one of the second scan signals is first applied to the first scan line of the current one of the pixel circuits, and a next one of the second scan signals following the one of the second scan signals applied to the first scan line of the current one of the pixel circuits is then applied to the second scan line of the current one of the pixel circuits.

4. The display device of claim 3, wherein the next one of the first scan signals is also applied to the first scan line of a next one of the pixel circuits.

5. The display device of claim 4, wherein the signal applier comprises:

a first switch to selectively couple an input line for inputting the next one of the first scan signals to the second scan line of the current one of the pixel circuits; and a second switch to selectively couple the input line to the first scan line of the next one of the pixel circuits.

6. The display device of claim 4, wherein the next one of the second scan signals is also applied to the first scan line of a previous one of the pixel circuits.

7. The display device of claim 6, wherein the signal applier comprises:

a first switch to selectively couple an input line for inputting the next one of the second scan signals to the second scan line of the current one of the pixel circuits; and a second switch to selectively couple the input line to the first scan line of the previous one of the pixel circuits.

8. The display device of claim 3, wherein the current one of the pixel circuits is arranged adjacent to the next one of the pixel circuits and wherein at least one of the first and second scan lines of the current one of the pixel circuits differs from at least one of the first and second scan lines of the next one of the pixel circuits.

9. The display device of claim 4, wherein the current one of the pixel circuits and the next one of the pixel circuits are arranged adjacent to each other.

10. The display device of claim 5, wherein the current one of the pixel circuits and the next one of the pixel circuits are arranged adjacent to each other.

11. The display device of claim 6, wherein the previous one of the pixel circuits, the current one of the pixel circuits, and the next one of the pixel circuits are arranged adjacent to each other.

12. The display device of claim 7, wherein the previous one of the pixel circuits, the current one of the pixel circuits, and the next one of the pixel circuits are arranged adjacent to each other.

13. The display device of claim 3, wherein the next one of the second scan signals is also applied to the first scan line of a previous one of the pixel circuits.

14. The display device of claim 13, wherein the signal applier comprises:

a first switch to selectively couple another input line for inputting the next one of the second scan signals to the second scan line of the current one of the pixel circuits; and a second switch to selectively couple the another input line to the first scan line of the previous one of the pixel circuits.

15. The display device of claim 13, wherein the previous one of the pixel circuits and the current one of the pixel circuits are arranged adjacent to each other and wherein at least one of the first and second scan lines of the current one of the pixel circuits differs from at least one of the first and second scan lines of the previous one of the pixel circuits.

16. A display device comprising:

a bi-directional signal transmission shift register for sequentially outputting a first signal and a second signal in a first direction in response to a first control signal and for sequentially outputting a third signal and a fourth signal in a second direction opposite to the first direction in response to a second control signal;

a first pixel circuit including a first scan line and a second scan line; and a signal applier for applying the first signal to the first scan line and the second signal to the second scan line in response to the first control signal and for applying the third signal to the first scan line and the fourth signal to the second scan line in response to the second control signal.

17. The display device of claim 16, further comprising:

a data driver for generating a plurality of data signals to be transmitted in a first direction, based on the first control signal, for generating the plurality of data signals to be transmitted in a second direction, based on the second control signal, and for applying the data signals to data lines.

18. The display device of claim 17, further comprising:

a second pixel circuit arranged adjacent to the first pixel circuit in the first direction, wherein the second signal is applied to a first scan line of the second pixel circuit.

19. The display device of claim 18, further comprising:

a third pixel circuit arranged adjacent to the first pixel circuit in the second direction, wherein the fourth signal is applied to a first scan line of the third pixel circuit.

20. A method for driving a display device including a plurality of pixel circuits and a scan driver, the pixel circuits comprising first and second pixel circuits, each of the first and second pixel circuits being coupled to first and second scan lines and a data line, the scan driver applying scan signals to the scan lines the method comprising:

in a first-direction scan mode, applying a first one of the scan signals to the first scan line of the first pixel circuit, and then applying a second one of the scan signals to the second scan line of the first pixel circuit and to the first scan line of the second pixel circuit; and in a second-direction scan mode, applying the first scan signal to the first scan line of the second pixel circuit, and then applying the second scan signal to the second scan line of the second pixel circuit and to the first scan line of the first pixel circuit.

* * * * *

UNITED STATES PATENT AND TRADEMARK OFFICE

CERTIFICATE OF CORRECTION

PATENT NO. : 7,427,971 B2
APPLICATION NO. : 11/077354
DATED : September 23, 2008
INVENTOR(S) : Ki-Myeong Eom It is certified that error appears in the above-identified patent and that said Letters Patent is hereby corrected as shown below:

In the Claims

| | |
|---|---|
| Column 11, line 61, Claim 2 | Delete "signal",<br>Insert --signals-- |

Signed and Sealed this

Twenty-fourth Day of February, 2009

JOHN DOLL
*Acting Director of the United States Patent and Trademark Office*